United States Patent [19]

Lee

[11] Patent Number: 4,910,360

[45] Date of Patent: Mar. 20, 1990

[54] CABLE ASSEMBLY HAVING AN INTERNAL DIELECTRIC CORE SURROUNDED BY A CONDUCTOR

[76] Inventor: Noel Lee, 47 W. Park Dr., Daly City, Calif. 94015

[21] Appl. No.: 293,642

[22] Filed: Jan. 5, 1989

[51] Int. Cl.[4] ..... H01B 7/08

[52] U.S. Cl. ..... 174/117 F; 174/113 C; 174/115; 174/131 A

[58] Field of Search ..... 174/113 C, 131 A, 117 F, 174/117 R, 115

[56] References Cited

U.S. PATENT DOCUMENTS

| | | | |
|---|---|---|---|
| 2,014,214 | 9/1935 | Smith | 174/34 |
| 2,193,429 | 3/1940 | McConnell | 174/131 A |
| 2,216,340 | 10/1940 | Elliott | 174/103 |
| 2,286,827 | 6/1942 | Morrison | 174/115 |
| 2,302,839 | 11/1942 | Burgett | 174/113 C |
| 2,309,439 | 1/1943 | Burgett | 174/113 C |
| 2,455,773 | 12/1948 | Johnson | 174/117 R |
| 2,509,894 | 5/1950 | Toulmin et al. | 174/128 R |
| 2,581,472 | 1/1952 | Dudley et al. | 174/117 F |
| 2,584,027 | 1/1952 | Kendrick | 174/113 G |
| 2,658,014 | 11/1953 | Morrison | 174/113 R |
| 2,953,627 | 9/1960 | Malnefitch et al. | 174/102 R |
| 2,998,840 | 9/1961 | Davis | 174/113 C |
| 3,032,604 | 5/1962 | Timmons | 174/115 |
| 3,211,821 | 10/1965 | Wakefield | 174/26 R |
| 3,291,891 | 12/1966 | Sharp | 174/36 |
| 3,324,233 | 6/1967 | Bryant | 174/131 R |
| 3,355,544 | 11/1967 | Costley et al. | 174/106 R |
| 3,413,799 | 12/1968 | LeJeune | 57/217 |
| 3,465,092 | 9/1969 | Schwartz | 174/78 |
| 3,584,139 | 6/1971 | Swanson | 174/103 |
| 3,602,632 | 8/1971 | Ollis | 174/36 |
| 3,624,276 | 11/1971 | Rawlins et al. | 174/129 R |
| 3,634,607 | 1/1972 | Coleman | 174/113 R X |
| 3,644,659 | 2/1972 | Campbell | 174/36 X |
| 3,772,454 | 11/1973 | Donecker et al. | 174/113 R |
| 3,773,109 | 11/1973 | Eberline | 174/115 X |
| 3,784,732 | 1/1974 | Whitfill | 174/108 |
| 3,789,130 | 1/1974 | Parker | 174/115 |
| 3,816,644 | 6/1974 | Giffel et al. | 174/115 |
| 4,025,715 | 5/1977 | Foley et al. | 174/36 |
| 4,028,660 | 6/1977 | Pitts, Jr. | 174/115 X |
| 4,358,636 | 11/1982 | Ijff et al. | 174/103 |
| 4,449,012 | 5/1984 | Voser | 174/117 F X |
| 4,461,923 | 7/1984 | Bogese, II | 174/36 |
| 4,486,623 | 12/1984 | Ploppa | 174/113 R |
| 4,538,023 | 8/1985 | Brisson | 174/115 |
| 4,677,256 | 6/1987 | Bauer et al. | 174/116 |
| 4,731,506 | 3/1988 | Lee | 174/117 F X |
| 4,734,544 | 3/1988 | Lee | 174/117 F |
| 4,743,712 | 5/1988 | Lee | 174/113 C |
| 4,767,890 | 8/1988 | Magnan | 174/115 X |
| 4,777,324 | 10/1988 | Lee | 174/115 X |

FOREIGN PATENT DOCUMENTS

| | | | |
|---|---|---|---|
| 1465554 | 8/1964 | Fed. Rep. of Germany . | |
| 2900302 | 5/1979 | Fed. Rep. of Germany . | |
| 1472221 | 1/1967 | France . | |
| 1377922 | 2/1988 | U.S.S.R. | 174/113 C |

*Primary Examiner*—Morris H. Nimmo
*Attorney, Agent, or Firm*—Warren B. Kice

[57] ABSTRACT

A cable assembly in which a pair of cables are provided to carry the positive and negative signals between a power source and a load. Each cable consists of a conductor wrapped around a dielectric core, and a plurality of bundles of wire strands are twisted around the wrapped dielectric core. The wire strands forming each bundle are twisted in a first direction and the bundles are twisted around the solid conductor in a direction opposite the first direction. Insulation extends around the bundles of wire strands.

23 Claims, 1 Drawing Sheet

CABLE ASSEMBLY HAVING AN INTERNAL DIELECTRIC CORE SURROUNDED BY A CONDUCTOR

BACKGROUND OF THE INVENTION

This invention relates to a cable assembly for transmitting an electrical signal between a power source and a load.

Various types of cables have been used to transfer electrical current between a power source and a load. For example, the signal from an audio amplifier is transmitted by a cable to a loudspeaker for producing a replica of a signal from a program source that is introduced to the amplifier. However, there is much controversy as to the optimum type of cable that should be used in these types of environments.

SUMMARY OF THE INVENTION

It is an object of the present invention to provide a signal cable assembly in which a plurality of wire strands are provided which carry the signal.

It is a further object of the present invention to provide a cable assembly of the above type in which the wire strands are grouped into bundles and wrapped around a dielectric core.

It is a further object of the present invention to provide a cable assembly of the above type in which a conductor is wrapped around the dielectric core.

It is a still further object of the present invention to provide a cable assembly of the above type which is relatively flexible and easy to handle and install.

Toward the fulfillment of these and other objects, the cable assembly of the present invention includes a plurality of bundles of wire strands wrapped around a dielectric core around which is wrapped a conductor.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawings wherein.

DESCRIPTION OF THE PREFERRED EMBODIMENT

Figure 1:
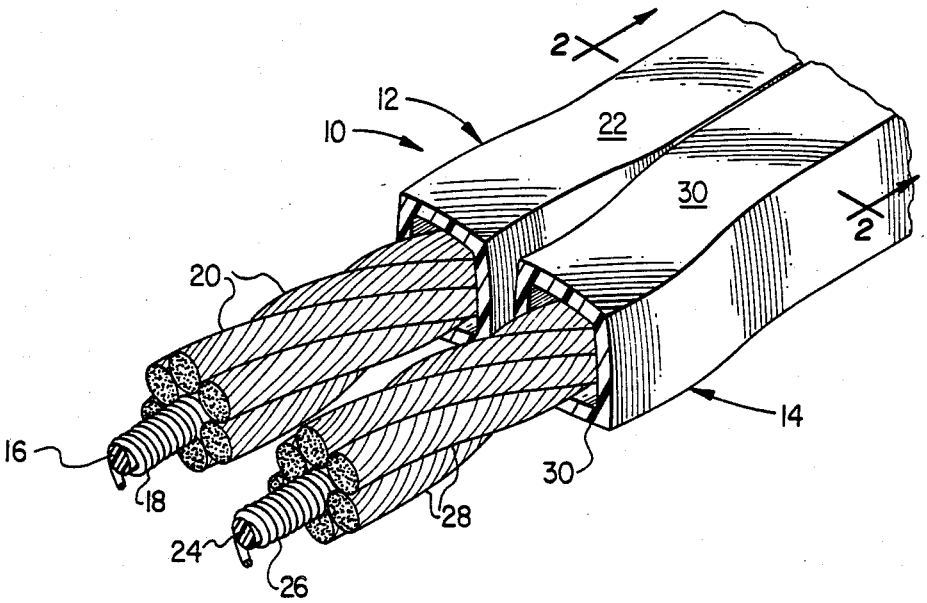
FIG. 1 is a partial perspective view depicting the signal cable assembly of the present invention, with the insulation being removed from the end portions thereof for convenience of presentation.

Referring specifically to the drawings the reference numeral 10 refers in general to the signal cable assembly of the present invention which comprises a first cable 12 extending in a juxtaposed, parallel relationship to a second cable 14.

The cable 12 is formed by a central, solid, rod-like dielectric core 16 arund which is wound a single conductor 18. Six bundles 20 of wire strands are twisted about the wrapped core 16 and, as shown by the curved lines, the wire strands forming each bundle 20 are twisted in a direction opposite that of the direction of twist of the bundles around the wrapped core 16.

An insulating sleeve 22 extends around the bundles 20, is fabricated of an insulating material, such as plastic or rubber, and has a substantially rectangular cross section.

In a similar manner, the cable 14 comprises a dielectic core 24 about which is wrapped a conductor 26. Six bundles 28 of wire strands are twisted around the wrapped core 24 in a direction opposite to that of the twist of the wire strands forming each bundle. An insulating sleeve 30 extends around the twisted bundles 28.

The cores 16 and 24 are fabricated from a dielectric material such as polypropylene, and the conductors 18 and 26, as well as the wire strands forming the bundles 20 and 28, are formed of a current carrying material, such as copper. The conductors 18 and 26 can be of a relatively thick gauge such as 20 gauge (AWG) while the wire strands forming the bundles 20 and 28 are of a relatively thin gauge such as 36 gauge (AWG). According to a preferred embodiment, each bundle 20 and 28 consists of approximately forty-eight strands. The conductors 18 and 26 are wound around their respective cores 16 and 24, while the strands of each bundle 20 and 28 are wound around their respective wrapped cores. The bundles 20 and 28, in turn, are wound around their respective wrapped cores 16 and 24.

Figure 2:
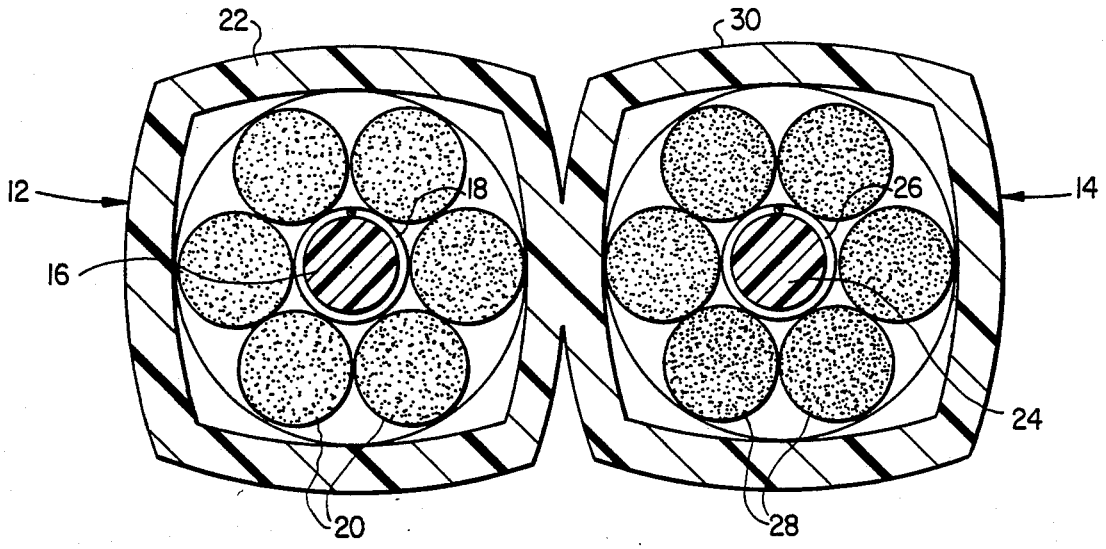
FIG. 2 is a cross-sectional view taken along the line 2—2 of FIG. 1.

As shown in FIG. 2 the insulating sleeves 22 and 30 are disposed in a juxtaposed, parallel relationship with their corresponding sidewall portions being molded together. The lengths of the conductors 18 and 26 and the wire strands forming the bundles 20 and 28 are approximately the same.

In FIG. 1, the insulating sleeves 22 and 30 of the cables 12 and 14, respectively, have been removed from the end portions of cables to show the uninsulated end portions of each cable which are connected to a power source and/or load. Also, the lengths of the wrapped cores 16 and 24 have been extended in FIG. 1 to better depict their features.

The conductor 18 and the bundles 20 together function as one cable and, as such, are connected together as a single cable to the power source or load. Similarly, the conductor 26 and the bundles 28 together function as a single cable. Since the dielectric cores 16 and 24 are nonconductive they are not connected to the power source or load.

One of the cables 12 or 14 can carry the positive signal and the other can carry the negative signal with the respective uninsulated ends of the conductors and wire strands being connected, as a single cable, via conventional connectors, such as spade lugs, banana plugs, or the like, to the positive and negative terminals of the power source and load.

Although not shown in the drawings, as an alternative embodiment, it is understood that the conductors 18 and 26 can be surrounded by insulation.

There are several advantages to the cable assembly of the present invention. For example, the dielectic cores 16 and 24 function to break up deliterious magnetic forces that would otherwise be present as a result of currents passing through the wire strands forming the bundles 20 and 28. Also, the larger gauge conductors 18 and 26 aid in properly transmitting the lower frequencies of the signal, and the opposite twisting of the wire strands forming each bundle 20 and 28 adds flexibility to each cable 12 and 14.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the spirit and scope of the invention therein.

What is claimed is:

1. A signal cable assembly comprising a pair of cables adapted to respectively carry the positive and negative signals between a power source and a load; each cable comprising a dielectric core, a single conductor wrapped around said core, a plurality of bundles of uninsulated wire strands extending around said wrapped core, the wire strands forming each bundle being twisted in a first direction and the bundles of each cable being twisted around their respective cores in a direction opposite said first direction, and insulating means extending around each cable, the conductor and the wire strands of each cable being connected as a single unit between a power source and a load.

2. The assembly of claim 1 wherein said dielectric core is in the form of an elongated, rod-like, solid dielectric material extending for the entire length of its respective cable.

3. The cable of claim 1 wherein the length of each conductor is approximately equal to the length of each wire strand.

4. The cable assembly of claim 1 wherein said cables are disposed in a juxtaposed parallel relationship with their respective insulation means being molded together.

5. The assembly of claim 1 wherein said bundles are uninsulated.

6. A signal cable assembly comprising a pair of cables adapted to respectively carry the positive and negative signals between a power source and a load; each cable comprising a dielectric core, a single conductor wrapped around said core, a plurality of bundles of uninsulated wire strands extending around said wrapped core, each conductor being greater than the diameter of each wire strand, and insulation means extending around each cable, the conductor and the wire strands of each cable being connected as a single unit between a power source and a load.

7. The assembly of claim 6 wherein said dielectric core is in the form of an elongated, rod-like, solid dielectric material extending for the entire length of its respective cable.

8. The cable of claim 6 wherein the length of each conductor is approximately equal to the length of each wire strand.

9. The cable assembly of claim 6 wherein said cables are disposed in a juxtaposed parallel relationship with their respective insulation means being molded together.

10. The assembly of claim 6 wherein said single conductor is uninsulated.

11. The assembly of claim 6 wherein said uninsulated wire strands are in contact with said single conductor.

12. The assembly of claim 6 wherein said bundles are uninsulated.

13. A signal cable assembly comprising a pair of cables adapted to respectively carry the positive and negative signals between a power source and a load; each cable comprising a dielectric core, an uninsulated single conductor wrapped around said core, a plurality of bundles of uninsulated wire strands extending around said wrapped core, and insulation means extending around each cable, the conductor and the wire strands of each cable being connected as a single unit between a power source and a load.

14. The assembly of claim 13 wherein said dielectric core is in the form of an elongated, rod-like, solid dielectric material extending for the entire length of its respective cable.

15. The cable of claim 13 wherein the length of each conductor is approximately equal to the length of each wire strand.

16. The cable assembly of claim 13 wherein said cables are disposed in a juxtaposed parallel relationship with their respective insulation means being molded together.

17. The assembly of claim 13 wherein said uninsulated wire strands are in contact with said single conductor.

18. The assembly of claim 9 wherein said bundles are uninsulated.

19. A signal cable assembly comprising a pair of cables adapted to respectively carry the positive and negative signals between a power source and a load; each cable comprising a dielectric core, a single conductor wrapped around said core, a plurality of bundles of uninsulated wire strands extending around said wrapped core and in contact with said single conductor, and insulation means extending around each cable, the conductor and the wire strands of each cable being connected as a single unit between a power source and a load.

20. The assembly of claim 19 wherein said dielectric core is in the form of an elongated, rod-like, solid dielectric material extending for the entire length of its respective cable.

21. The cable of claim 19 wherein the length of each conductor is approximately equal to the length of each wire strand.

22. The cable assembly of claim 19 wherein said cables are disposed in a juxtaposed parallel relationship with their respective insulation means being molded together.

23. The assembly of claim 6 wherein said bundles are uninsulated.

* * * * *